United States Patent [19]

Whitaker

[11] 4,055,843

[45] Oct. 25, 1977

[54] ANNUNCIATOR FOR USE WITH ELECTRONIC DIGITAL CLOCK

[76] Inventor: Ranald O. Whitaker, 4719 Squire Drive, Indianapolis, Ind. 46241

[21] Appl. No.: 660,611

[22] Filed: Feb. 23, 1976

[51] Int. Cl.[2] ..... G04C 21/04

[52] U.S. Cl. ..... 340/384 E; 58/13; 58/23 R; 58/38 R; 340/407

[58] Field of Search ..... 58/23 R, 38, 13, 39.5, 58/39, 152 B; 340/384 E, 407

[56] References Cited

U.S. PATENT DOCUMENTS

| | | | |
|---|---|---|---|
| 3,284,796 | 11/1966 | Borsattino et al. | 340/384 E |
| 3,759,029 | 9/1973 | Komaki | 58/38 |
| 3,931,621 | 1/1976 | Rose | 340/384 E |
| 3,938,317 | 2/1976 | Spano | 58/23 R |

*Primary Examiner*—Marshall M. Curtis

[57] ABSTRACT

The present invention provides a system whereby electronic digital clocks may announce the exact time every ten minutes. The hour is announced by a sequence of four tones. Each tone in the sequence is high if the corresponding bit of a binary numbering system representation of the hour digit is high. The tone is low otherwise. The tens of minutes digit is announced in similar manner, except that only three tones are required in the sequence. The system may be used to announce numbers emanating from computers or other electronic digital devices.

8 Claims, 4 Drawing Figures

ANNUNCIATOR FOR USE WITH ELECTRONIC DIGITAL CLOCK

SUMMARY

In the electronic digital systems such as present day digital clocks a digit is represented by a set of four signals corresponding respectively to four bits of the binary numbering system representation of the digit. Each digit has a maximum value of 15. According to the present invention each digit is represented by a sequence of audible tones. For each high signal a high tone is generated. For each low signal a low tone is generated. Each particular combination of tones in a sequence represents the corresponding digit of a base 16 numbering system. When more than one digit is to be sounded, a pause between digits is provided in the preferred embodiment of the present invention. To facilitate recognition of time slots in the sequence two high tones and two low tones are provided. The first high tone and the first low tone are sounded in time slots 1 and 3. The second high tone and second low tone are sounded in time slots 2 and 4. To alert the user an "Attention" tone is sounded two seconds before an annouhcement is made.

The annunciator comprises four main sections —a time slot generator for defining the time slots of the audible digit, an audio oscillator for generating the audio frequency signals, a selector for selecting the audio signals in accordance with the source digital information, and an audio output section for generating the tones selected by the selector.

Prime application of the invention is in making announcements of the time from an electronic digital clock. Time is generally announced every ten minutes.

BACKGROUND

The Arabic-decimal system of numbering has served us well during the 500 years since it replaced the Roman numeral system. However, the ever extending use of computers and other digital systems which employ the binary numbering system indicates that the Arabic-decimal system may soon be retired in favor of a system which is compatible with the binary system. The base-16 system is such a system—with its grouping of binary bits into groups of four.

To further accommodate communication with binary digital systems a "Computer Compatible Digit" becomes useful. Such a digit consists of four elements, each element corresponding to a bit of the corresponding base-16 digit. The digit may be visible as discussed in copending U.S. Pat. Application Ser. No. 593,434—or audible as disclosed in the present Application.

A prime use for audible digits is in clocks. It is convenient to have a clock announce the time on the hour and at other appropriate intervals. Audible digits are also of utility in instrumentation where an operator needs to know a digital value but cannot take his eyes from a process or object being observed. Audible digits become useful for passing numerical information to aircraft pilots and to automobile drivers. Such audible digits may be spoken words of the English or other language. They may be bells, whistles, or tones. The only requirement is that the sound or sounds generated be recognized by the human auditory system as representing a particular digit. Since electronic digital equipment generally represents digits by four signal bits each of which may be high or low, it becomes convenient to form audible digits from four audible bits, each of which may be either high or low. The present invention provides implementation for such a system.

THE DRAWINGS

DETAILED DESCRIPTION OF PREFERRED EMBODIMENT

Figure 1:
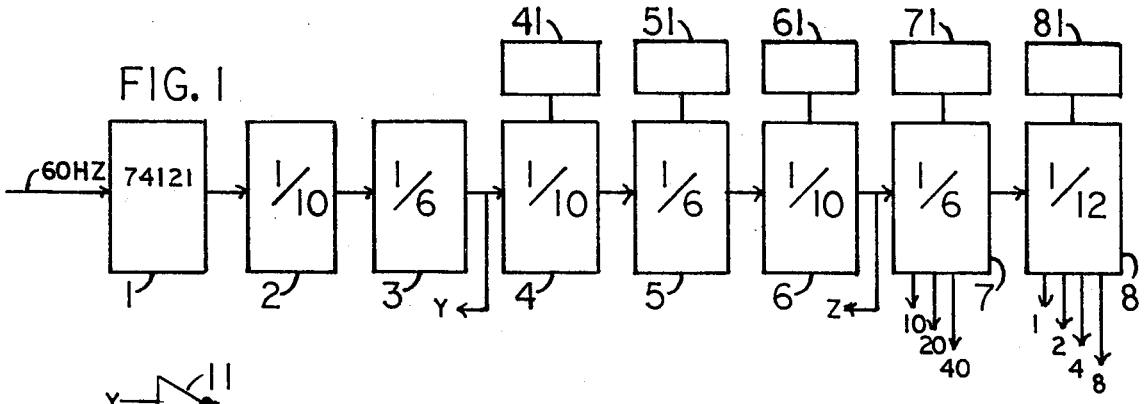
FIG. 1 is a block diagram of a digital clock in conjunction with which the present invention may be used.

A digital clock of common configuration is diagrammed in FIG. 1.

A 60 Hz signal taken from the 60 Hz line is fed to block 1 which is a one-shot multivibrator (TTL Type 74121). Input is to the Schmitt trigger section. Firing period is slightly less than 1/60th second. This renders the system virtually immune to noise since any noise appearing during the firing period has no effect.

The output of the one-shot is fed to a 1/10 divider indicated by block 2 and thence to a 1/6 divider indicated by block 3. These may be TTL type 7490 and 7492 respectively. The output of block 3 becomes a pulse per second. Block 4 is a 1/10 counter, TTL type 7490. Its four outputs are fed to a display 41, preferably of the type discussed in copending Application Ser. No. 593,434. Block 5 is preferably a TTL type 7492 which divides by 6 and feeds to display 51. This provides a display of tens of seconds. Block 6 is a 1/10 counter giving an output in minutes—preferably a TTL type 7490. It feeds to display 61. Block 7 is a 1/6 counter giving a tens of minutes output—preferably a TTL type 7492. It feeds to display 71. Block 8 is a 1/12 divider giving hours output—preferably a TTL type 7493 with the 8 and 4 outputs wired to the Reset inputs. It feeds to display 81.

Significant for future reference is the face that the output of block 6 (Point Z) undergoes a negative transition each time the tens of minutes digit changes. Also significant if the nature of the output of block 7. Outputs 10, 20, and 40 are a binary numbering system representation of Arabic numerals 0, 1, 2, 3, 4, and 5. The count is continuously repetitive. For block 8 the outputs 1, 2, 4, and 8 are a binary numbering system representation of Arabic numerals 0, 1, 2, 3, 4, 5, 6, 7, 8, 9, 10, and 11. The count is continuously repetitive.

It is of interest that the conventional hour identified by 12 is identified in this digital clock by 00. This change in identification is made to accommodate the operational characteristics of binary logic circuitry. Since the human mind can learn one identification as easily as another, the change is made at no cost. The inverse in which the clock is modified to provide an indication of "12" hours would entail a recurring cost which cannot be justified.

Figure 2:
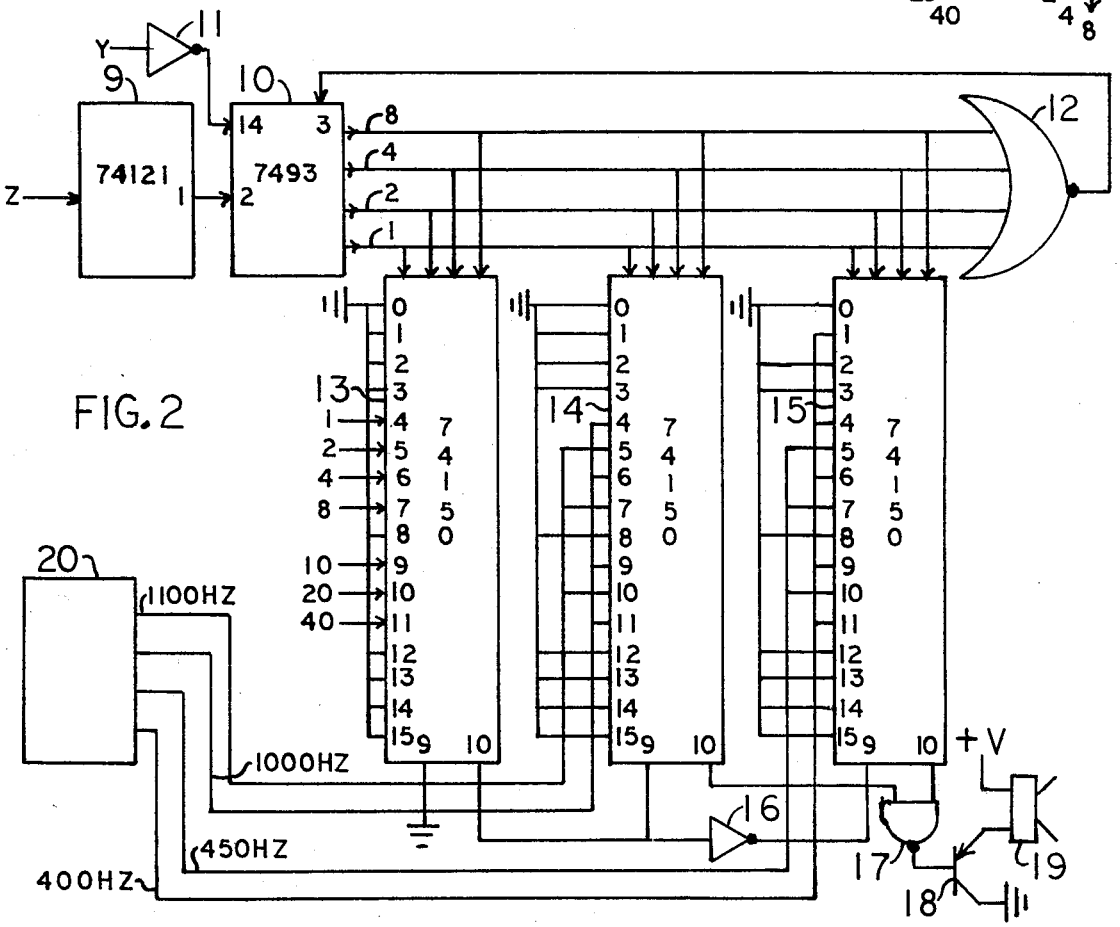
FIG. 2 is a diagram of the preferred annunciator system.

It is also of interest that 11 is represented by one digit rather than two. This can be done since the Computer Compatible Digit provides a count up to 15. Annunciator circuitry is shown in FIG. 2.

The ten minutes negative going transition signal appearing at point Z of FIG. 1 is fed to one-shot multivibrator block 9, generally a TTL 74121. The one-shot is arranged to have a firing period of approximately 1 second. The complementary output of the one-shot is fed to one of the reset inputs of block 10, a TTL 7493 counter. Consequently the counter is enabled for counting during the one-second firing period of block 9.

Normally all four outputs of block 10 are low. This causes the output of nor gate 12 to be high. As long as both pin 2 and pin 3 of block 10 are high, block 10 is held in reset with all outputs low. The counting input to block 10 is taken from point Y of FIG. 1. Consequently block 10 counts seconds. Passage of the signal through inverter 11 causes the counting transition of the signal input to pin 14 of block 11 to occur some ⅔rd seconds after block 9 fires. This causes block 10 to step from the 0 output state to the 1 state. Which causes the output of nor gate 12 to go low. When block 9 times out, pin 2 of block 10 goes high. However, counting continues since pin 3 is now held low. The count proceeds at a rate of a count per second until the count passes 15 and returns to 0. The return to 0 causes the output of nor gate 12 to go high, locking the system in reset until another input signal from point Z is received. This will be ten minutes later.

The system above described is referred to as a time slot generator. With each triggering from its Z input it produces a sequence of 15 time slots each of 1 second duration.

Blocks 13, 14, and 15 are multiplexers, preferably TTL type 74150. Each multiplexer has 16 data inputs and four selector inputs. The selector inputs are fed from the outputs of block 10. The outputs of block 10 are normally in a zero state. Triggering of the time slot generator causes these outputs to count in the binary numbering system down through the digits 1 to 15 and back to 0 again. These counts feeding to each of the multiplexers cause the respectively numbered time slot inputs appearing along the left edges of the blocks to be inverted and connected successively to respective output pins 10. Time slot inputs 4, 5, 6, and 7 are fed by the hours outputs 1, 2, 4, and 8 respectively. Time slot inputs 9, 10, and 11 are fed from the tens-of-minutes outputs 10, 20, and 40 respectively.

Consider the action during the 0 time slot. The 0 input to block 13 is low. Since pin 9 is tied low, block 13 is enabled. Since the multiplexer inverts the input and the input is low, a high is delivered to pin 10. The high at pin 10 causes block 14 to be disabled. When a multiplexer is disabled, the output pin 10 goes high. Consequently pin 10 of block 14 goes high. Inverter 16 causes a low to appear at pin 9 of block 15. This enables block 15. Since the 0 input is addressed and the zero input is low, a high appears at pin 10. This high in conjunction with the high appearing at pin 10 of block 14 causes nand gate 17 to go low, shutting off transistor 18 and muting speaker 19.

Consider next the action during the 1 time slot. Each multiplexer addresses its respective input port 1. Block 14 is disabled and block 15 enabled. A 400 Hz signal is delivered to input 1 of block 15. This signal appears at output pin 10 of block 15. Since pin 10 of block 14 is still high, gate 17 is open and the 400 Hz signal is delivered to transistor 18 and causes a 400 Hz tone to be sounded from speaker 19. This tone is always sounded during time slot 1 regardless of any data inputs from the clock. This tone is referred to as the "Attention!" tone, since it is a warning that a time announcement is soon to be made.

During time slots 2, 3, 8, 12, 13, 14, and 15 the action is the same as for slot 0. Consequently the speaker is muted during these time slots. The two-second pause of silence provided by time slots 2 and 3 permit the listener to get ready for the time announcement.

Consider next the action during time slot 4. Consider first that bit 1 of the hours digit is high. This high at pin 4 of block 13 causes pin 10 of block 13 to go low. This enables block 14 and disables block 15. The input to the 4 slot of block 4 is a 1,000 Hz signal. Consequently this signal is delivered from output pin 10 to nand gate 17. The disabling of block 15 causes output pin 10 thereof to go high, opening gate 17 and delivering the 1,000 Hz signal to transistor 18. This causes speaker 19 to generate a 1,000 Hz audible signal.

If, during time slot 4, input 4 of block 13 is low, block 14 is disabled and block 15 is enabled. Since a 400 Hz signal is delivered to the 4 slot of block 15, a 400 Hz audible signal is generated. The action is the same as that during time slot 1.

In similar manner a high data input to slot 5 of block 13 will cause a 1,000 Hz audible signal to be generated during time slot 5.

A low data input to slot 5 of block 13 will cause a 450 Hz signal to be generated during time slot 5.

Similar actions take place for time slots 6, 7, 9, 10, and 11.

Figure 3:
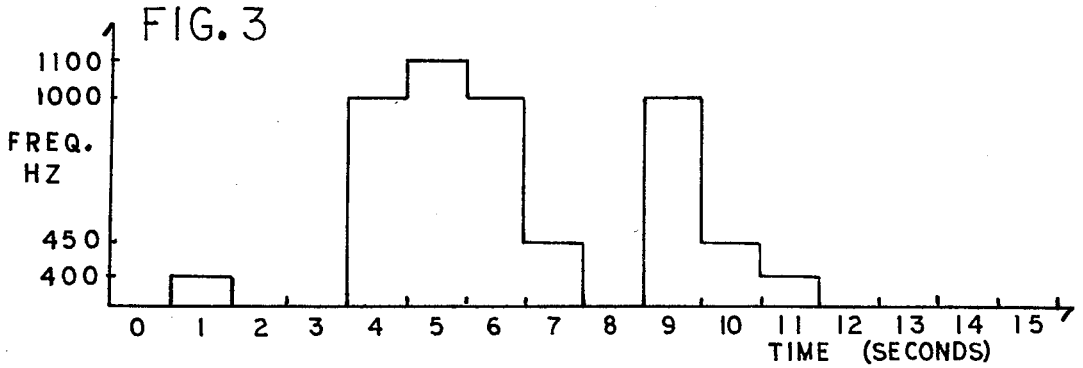
FIG. 3 is a timing diagram indicating tone sequence for an announcement when the clock reads 7:10.

Consider next the audible signal generated when the time slot reaches 7:10. Reference is made to FIG. 3. During the several time slots the tones indicated are generated. The action during time slots 4, 5, and 6 indicates why two high tones intermixed in time slots are provided. The intermixed high tone clearly indicate time slot boundaries. These boundaries would not be delineated if only one high tone were provided. Unless the listener were very attentive to time durations he could mistake the 7 for a 3. The action during time slots 10 and 11 indicate why intermixed low levels have been provided. Again, the change in tones indicates a boundary between slots 10 and 11. Were it not for the intermixed low level frequencies the digit could easily have been interpreted as a 3. However, in a very unsophisticated system a single high frequency and a single low frequency may be employed.

Blocks 13, 14, and 15 of FIG. 2 together with inverter 16 and nand gate 17 constitute the selector. In accordance with data input from the hours and tens-of-minutes counters of the clock this section selects tonal signals to be delivered to the audio output section.

Block 20 of FIG. 2 is an audio signal generator providing TTL compatible signals of the frequencies indicated or of any other suitable set of audio frequencies. In the preferred system the four frequencies were provided by a TCA 430-N quad organ oscillator built by ITT. They may as well be provided by a pair of TTL 7400's wired as multivibrators.

This invention comprises the following main elements:

1. A source of data signals. In the preferred embodiment this has been a clock and specifically the tens-of-minutes counter and the hours counter thereof. In more general applications it might be an angle encoder, a flowmeter, a voltmeter, or any other device providing as output a set of binary signals.

2. An initiator means for causing an announcement to be made. In the preferred embodiment this has been the clock and specifically the output stage of the minutes counter. In more general applications it could be a switch closure or any action equivalent thereto. In many cases a human operator would physically close a switch.

3. A time slot generator—as covered in detail above. Many variations are possible. A Johnson counter is one attractive variation. A manually operated multiposition switch is another. The preferred embodiment may well be that for which the necessary components are most readily available.

4. An audio frequency signal generator. The variations here are legion. In one attractive solution frequencies may be drawn from a counter whose count is being announced. In the present case symmetrical frequencies of 60 and 30 pulses per second may be drawn from the counter. Non-symmetrical frequencies of 12 and 6 pulses per second may be drawn. However, these frequencies are hardly compatible with the human auditory system. In counters employing crystal oscillators of frequencies considerably higher than 60 Hz, this technique becomes applicable.

Figure 4:
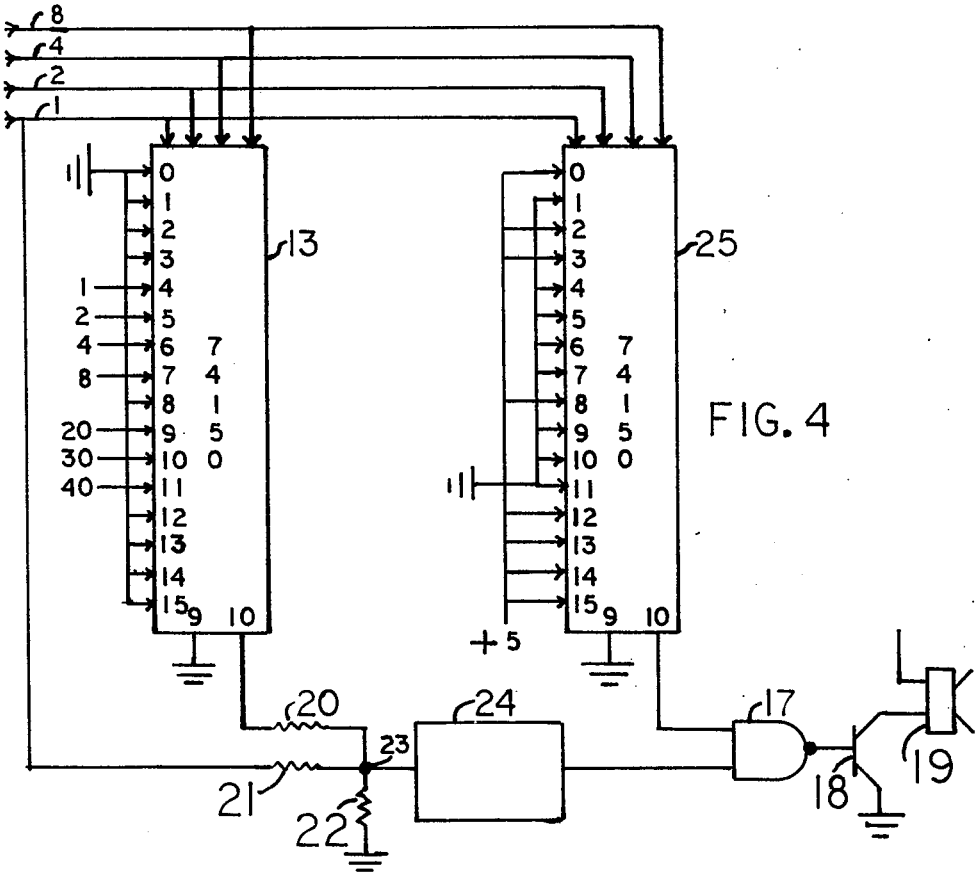
FIG. 4 is a block diagram of an alternate selector system.

5. A selector—as covered in detail above. Other possible embodiments are many. The above covered embodiment was selected because the explanation is simplest. From a hardware point of view a system using gates and designed from Karnaugh maps is simplest. However, the explanation becomes hopelessly involved. One set of other possible embodiments uses a VCO (Voltage Controlled Oscillator). One particular implementation from this set set is diagrammed in FIG. 4. The selector inputs of multiplexers 13 and 25 are driven from the time slot generator of FIG. 2. Data inputs of multiplexer 13 are the same as for the apparatus described in FIG. 2. Data inputs for multiplexer 25 are fixed to give a high at output 10 thereof for those time slots for which a tone is to be sounded. Block 24 is a VCO giving an output frequency dependent upon the voltage appearing at its input 23. Resistor 20 is fed from output 10 of multiplexer 13. Resistor 21 is fed from the 1 output of the time slot generator. The 1 output voltage alternates between high and low with each passing time slot. Resistors 20, 21, and 22 form a summing junction at input 23 of VCO 24. VCO 24 may be the popular 555 timer chip coupled as a pulse width modulator. Resistor 21 is much larger than resistor 20. Consequently the output frequency of VCO 24 makes a large shift when the input from pin 10 of multiplexer 13 changes between high and low and a small shift when input 1 changes. The output of FCO 24 is fed to nand gate 17. This gate is opened when the output 10 of multiplexer 25 is high. Consequently it is opened during those time slots for which a tone should appear. Output of nand gate 17 is fed to PNP power transistor 18. The output of transistor 18 is fed to speaker 19. The overall action is the same as for the configuration of FIG. 2. In one small variation from the cct of FIG. 4, multiplexer 25 turns VFO 24 on and off. This permits gate 17 to be eliminated. Shift registers may be used to implement the selector in another embodiment of major importance. Shift registers become mandatory in those cases where the input data changes during the announcement period.

6. An audio output section. That covered above is perhaps the simplest. But it is hardly the most efficient. Also, the tones produced are not pleasant to the ear. Any of the many audio output circuits covered in the literature may be used.

Several elements covered in the preferred embodiment may be eliminated without departure from the basic invention. No warning tone need be provided. The audible digits may be composed of three time slots, rather than four. This would accommodate a base-8 (octal) numbering system. Note that in the clock application base-16 was used for the hours digit and base-8 for the tens of minutes. This dual system was rendered appropriate by the conventional manner of reading clocks. The muted separations of the tone sets may be eliminated and a continuous sequence of tones generated. This would be appropriate for a system using the pure binary numbering system.

The above discussion has concerned representation of digits by audible tone sequences. However, once a code is decided upon, letters of the alphabet and other characters may be so announced as well as digits. The ASCII code, the EBCDIC code, and Rowcode are representative of such codes as may be used. In an attractive alternate application the above system less the audio output section may be used to transmit coded information over telephone lines. However, other means for such transmission have much higher data rates. The present invention provides a system which can be learned by the average person very easily. The learning period generally consists of listening to five sample digits. This was the prime requirement in the clock application. The data rate of the system of the present invention is about one-tenth that of the human voice. For communication purposes it would be desirable to have a data rate at least ten times that of the human voice.

I claim:

1. An annunciator system comprising:

a source of data signals, a subset of said data signals at any particular instant being in a high state, the remaining subset of said data signals being in a low state;

initiator means adapted for delivering an initiation signal when an announcement is to be made;

a time slot generator for generating a sequence of time slots and adapted for receiving said initiation signal and in response thereto adapted for generating a sequence of sets of time slot signals, each of said sets identifying a respective time slot in said sequence of time slots;

an audio frequency signal generator means adapted for generating a low frequency signal and for generating a high frequency signal;

audio output means adapted for receiving an input signal and adapted for delivering in response thereto an audio tone of like frequency; and selector means adapted for receiving as selector input said sets of time slot signals, said selector means adapted for receiving as data input said data signals, said selector means being adapted for associating each of said data signals with a respective time slot, said selector means adapted for selecting and causing to be delivered to said audio output means a particular one of said audio signals during those of said time slots for which said respective data signals are high and for selecting and causing to be delivered to said audio output means the other of said audio signals during those of said time slots for which said respective data signals are low.

2. An annunciator system as in claim 1;

said selector means including mmeans for causing to be delivered to said audio output means an audio signal of arbitrary nature a fixed time prior to delivery of said audio signals corresponding to data signals.

3. An annunciator system as in claim 1;

each of said time slot signals comprising a plurality of binary signals, a subset of said binary signals at any particular instant being in a high state and the remaining subset being in a low state, the particular time slot identified being determined by the combination of high and low states of said plurality of binary signals.

4. An annunciator system as in claim 1;

said data signals being divided into groups, each of said groups comprising a maximum of four signals;

said selector means being adapted for assigning to each of said groups a plurality of successive time slots equal in number to the number of signals in said respective group; and said selector means being adapted for separating each of said groups from its adjacent group by a minimum of one time slot.

5. An annunciator system as in claim 4;

said audio generator being adapted for generating a first high tone and a second high tone, said second high tone differing slightly in frequency from said first high tone; and said selector means being adapted in response to a data signal calling for a high tone for selecting said first high tone for the first and third of said time slots and said second high tone for the second and fourth of said time slots.

6. An annunciator system as in claim 4;

said audio generator being adapted for generating a first low tone and a second low tone, said second low tone differing slightly in frequency from said first low tone, and said selector means being adapted in response to a data signal calling for a low tone, for selecting said first low tone for the first and third of said time slots and said second low tone for the second and fourth of said time slots.

7. An annunciator system as in claim 4;

said initiator being a digital clock incorporating an electronic counter;

said initiating signal being a transition signal from said counter which transition signal occurs every ten minutes;

a first of said data groups being the binary signals developed by the hours counter; and a second of said data groups being the binary signals developed by the tens-of-minutes counter.

8. An annunciator system as in claim 1;

said source of data signals being successive stages of a counter;

said initiator means being a particular stage of said counter; and said audio frequency generator means being stages of said counter which develop as outputs signals of appropriate audio frequency.

* * * * *